United States Patent [19]

Sexton et al.

[11] Patent Number: 4,499,031

[45] Date of Patent: Feb. 12, 1985

[54] EVAPORATIVE GAS TREATING SYSTEM

[75] Inventors: Robert W. Sexton; Richard L. Smith, both of Louisville, Ky.

[73] Assignee: Allis-Chalmers Corp., Milwaukee, Wis.

[21] Appl. No.: 423,536

[22] Filed: Sep. 27, 1982

[51] Int. Cl.[3] ..... B01F 3/04

[52] U.S. Cl. ..... 261/66; 62/176.4; 62/314; 236/44 C; 261/103; 261/112; 261/129; 261/DIG. 3; 261/DIG. 34; 261/DIG. 41

[58] Field of Search ..... 261/66, 129, 130, 103, 261/106, 110, 112, DIG. 3, DIG. 4, DIG. 34, DIG. 41; 236/44 C; 62/310, 314, 315, 176 C, DIG. 16, 176.4

[56] References Cited

U.S. PATENT DOCUMENTS

| | | | |
|---|---|---|---|
| 960,830 | 6/1910 | Cramer et al. | 261/DIG. 34 |
| 1,846,875 | 2/1932 | Karr et al. | 261/128 X |
| 2,095,873 | 10/1937 | Jensen | 261/103 X |
| 2,123,742 | 7/1938 | Offen | 261/128 X |
| 2,904,254 | 9/1959 | Bahnson, Jr. et al. | 236/44 C |
| 3,314,080 | 4/1967 | Shilling, Jr. | 261/DIG. 34 |
| 3,450,393 | 6/1969 | Munters | 261/112 |
| 3,537,692 | 11/1970 | Vick | 261/66 X |
| 3,738,621 | 6/1973 | Anderson | 261/DIG. 4 |
| 3,778,042 | 12/1973 | Schade et al. | 261/DIG. 34 |
| 3,820,353 | 6/1974 | Shiraishi et al. | 261/103 X |
| 4,379,712 | 4/1983 | Sperr, Jr. et al. | 261/DIG. 3 |
| 4,389,352 | 6/1983 | Bohanon, Sr. | 261/106 |

*Primary Examiner*—Richard L. Chiesa
*Attorney, Agent, or Firm*—Arthur L. Nelson

[57] ABSTRACT

A gas treating system including a housing forming a duct for a gas stream having a vertical panel of flow-through evaporative media secured across the duct, a blower mounted within the duct downstream from the panel adapted to draw the gas stream through the duct, a liquid dispersal assembly connected to a liquid supply adapted to conduct an evaporative treating fluid into the panel where it evaporates into the gas stream as it flows through the panel, and humidity or temperature sensors positioned within the duct downstream from the blower operatively connected with the liquid supply to increase and decrease the flow of liquid into the panel to maintain a preselected humidity or temperature in the gas stream as it flows out of the housing.

8 Claims, 7 Drawing Figures

EVAPORATIVE GAS TREATING SYSTEM

BACKGROUND OF THE INVENTION

1. Field of the Invention

The present invention relates to an evaporative gas treating system for humidifying and cooling a gas stream.

2. Description of the Prior Art

The prior art discloses numerous evaporative gas treating systems for maintaining the temperature and humidity of an air stream in a variety of applications such as conditioning the air circulated through industrial paint spray booths, cooling factory work stations, and humidifying the inlet air supplies for gas turbines.

In installations of this type, it is necessary to very closely control the temperature and humidity of relatively large air flows. Typically, the air stream is circulated through an evaporating section including one or more fiberous media pads which are saturated with water which evaporates into the air stream to increase its humidity and lower its temperature. One of the more common ways of varying the extent of humidification effected by this type of arrangement has been to vary the flow of water into one or more of the media panels. However, in this type of arrangement the water flow must be very closely controlled to compensate for changing ambient conditions as well as to maintain the efficiency of the system. For example, if too little water is fed into the media, the air stream will not reach the desired humidity or temperature levels. Alternatively, oversaturation of the media and uneven water distribution in the media panels can cause excessive water droplet carry-over into the air stream requiring the use of mist eliminators or the like to remove the water droplets downstream from the evaporating section such as provided in the cooling and humidifying system shown in U.S. Pat. No. 2,904,254. Moreover, when water is added to saturated media panels a substantial steam of water flows straight through the panels. This water must be collected and either drained from the system or pumped back to the pads and recirculated. In larger installations, it is usually essential to recirculate the excess water to maintain the operating costs for the unit within reasonable limits notwithstanding the expense and additional complexity resulting from the installation and maintenance of an additional pumping system.

SUMMARY OF THE INVENTION

The present invention relates to evaporative gas treating systems and in particular to an automatic gas cooling and humidification system.

The gas treating system includes a housing forming a duct adapted to conduct a gas stream through the housing, a vertical panel of flow-through evaporative media pads secured across the duct, a blower mounted within the duct downstream from the panel adapted to draw the gas stream through the duct, a liquid dispersal assembly connected to a liquid supply adapted to conduct an evaporative treating liquid into the panel where it evaporates into the gas stream flowing through the panel to humidify the gas stream, and a humidity sensor positioned within the duct downstream from the blower operatively connected with the liquid supply to selectively increase and decrease the flow of liquid into the panel to maintain a preselected humidity in the gas stream as it flows out of the housing. This arrangement has been found to be particularly suited for maintaining appropriate humidity levels in industrial paint spray booths and related uses where it is necessary to closely control the humidity in a gas stream. In an alternative arrangement adapted for cooling factory work stations and the like, a temperature sensor is positioned within the duct in the same manner as the humidity sensor. However, in that arrangement the temperature sensor is operatively connected with the liquid supply to selectively increase or decrease the flow of liquid into the panel to cool the gas stream to maintain its dry bulb temperature at a desired level.

It should be particularly noted that the invention essentially minimizes water consumption in the evaporative system as it only allows the saturation in the panels to proceed to the minimum point necessary to maintain the desired humidity, or alternatively, the desired dry bulb temperature. Thus, in addition to providing a relative straightforward and easily maintained arrangement, the invention also minimizes the long-term operating costs of the system.

When considering the foregoing, it is to be understood that various changes can be made in the arrangement, form, and construction of the apparatus disclosed herein without departing from the scope and spirit of the invention.

DESCRIPTION OF THE PREFERRED EMBODIMENT

Figure 1:
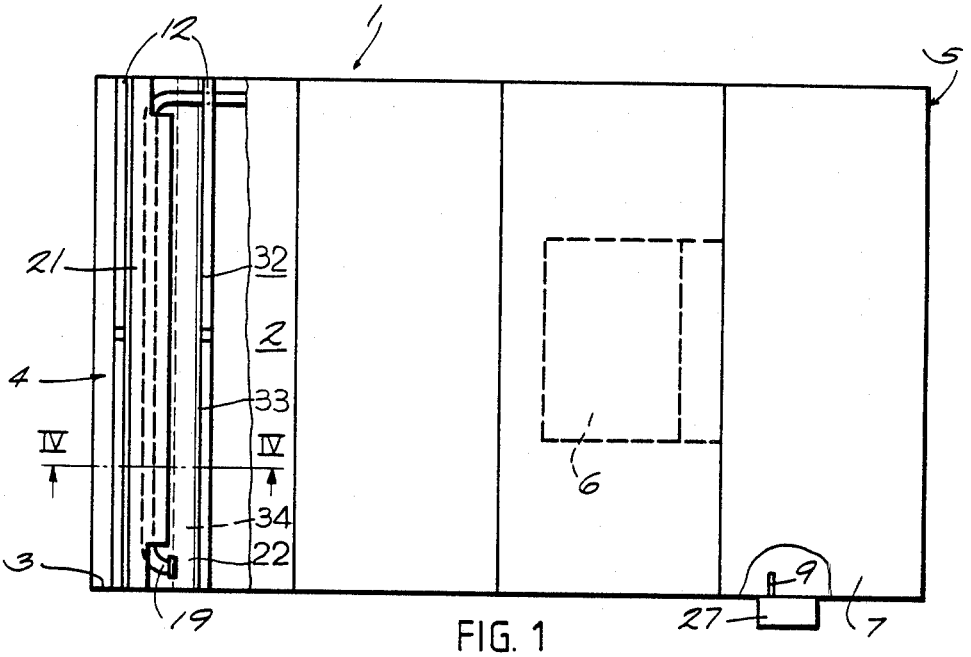
FIG. 1 is a plan view of the gas treating system.
Figure 2:
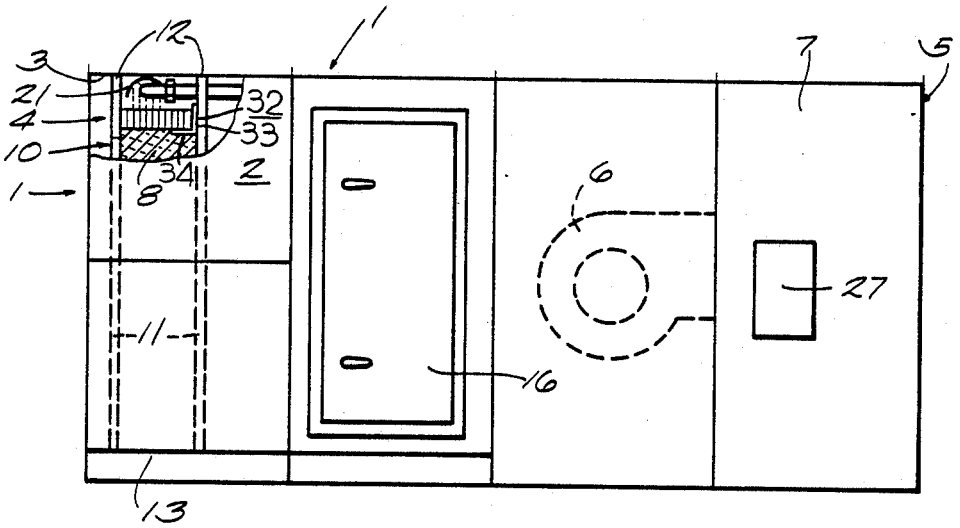
FIG. 2 is a side elevational view of the gas treating system shown in FIG. 1.

As shown in FIGS. 1 and 2, the evaporative gas treating system 1 embodying the invention includes a housing 2 of a generally rectangular cross-sectional configuration forming a duct 3 having a gas inlet 4 at one end and a gas outlet 5 at its other end. As will be described, during gas treating operations ambient air is drawn through the housing 2 by a fan or blower 6 secured in an outlet plenum 7 formed in the downstream end of the duct 3 which draws a stream of ambient air into the duct through the inlet 4 where it flows through a panel formed of a plurality of wetted pads of evaporative media 8 secured across the interior of the duct to humidify the air stream which is in turn directed out of the housing through the outlet 5 and conducted through suitable ducting (not shown) to the area or equipment served by the system. It should be particularly noted the invention provides for constantly controlling the extent of humidification, and thus the humidity of the air as it is discharged from the housing, by selectively adjusting the extent that the media pads are saturated during treating operations. This is accomplished by measuring the humidity of the air stream with a humidity sensor 9 positioned in the outlet plenum 7 and then increasing or decreasing the quantity of liquid, in this case water, used to wet the media pads to raise or lower the humidity of the air stream.

Figure 3:
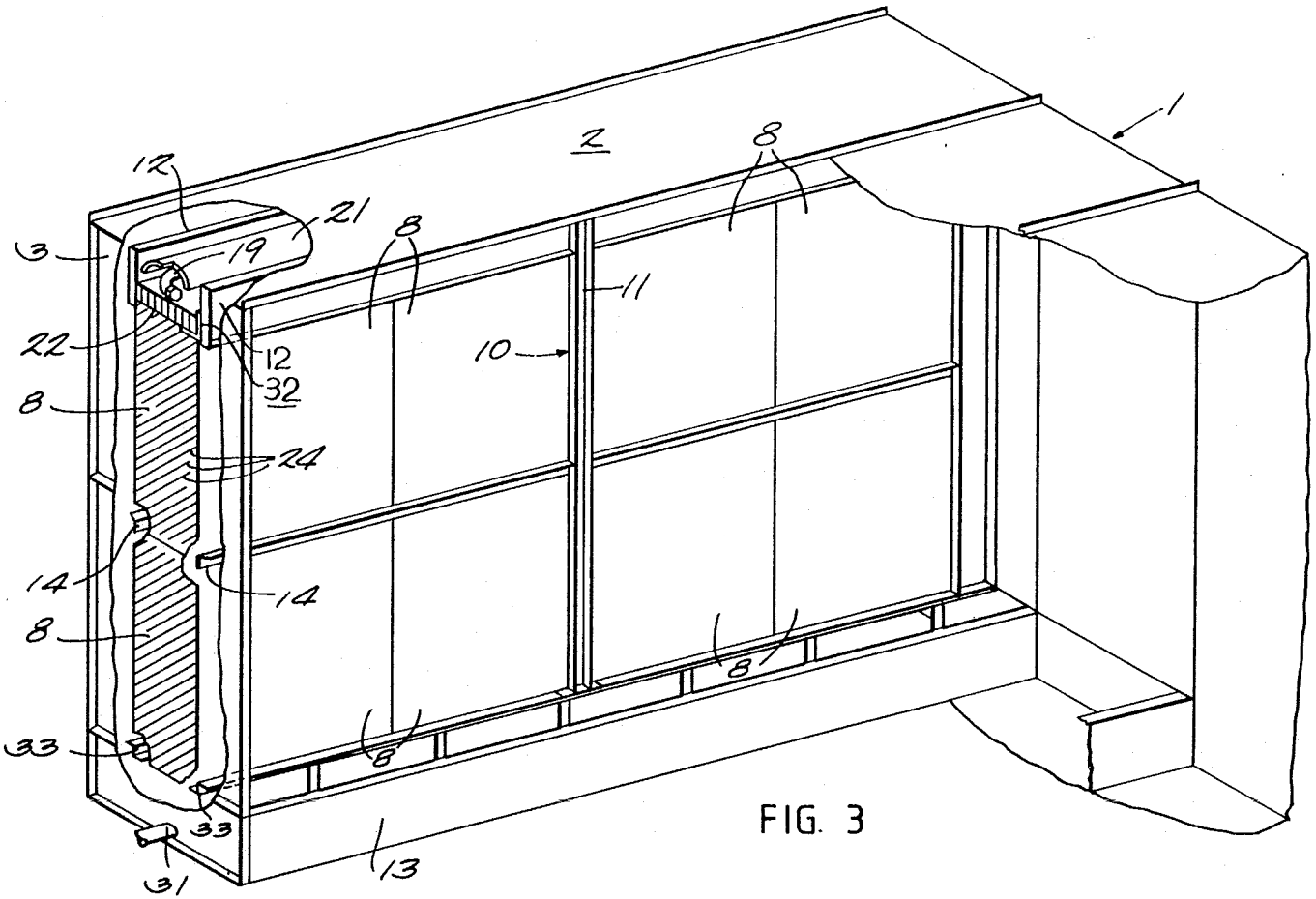
FIG. 3 is a perspective view showing the mounting frame for the media panels within the housing.

Referring to FIG. 3, the media pads 8 are mounted in the duct 3 in a flow-through frame 10 secured to the walls of the duct. The frame 10 is of a grid-like construction having spaced vertical beams 11 secured to a header box 12 at the top of the frame and to a base or drain pan 13 at the base of the frame including an outlet or discharge pipe 31 which accommodates draining the pan 13 during flushing operations or the like as will be described. In this arrangement, the pads 8 are releasably secured within the frame 10 in horizontal rows. The upper edge of the upper row is nestled within the lower rim of the upper header box 12, the lower edge of the lower row is nestled between a pair of Z-shaped cross members 33 secured across the top of the base pan 13, and the abutting horizontal edges of the two rows of panels are secured in place by horizontal cross members 14 releasably secured to the vertical beams 11 by appropriate bolts 15 interconnecting the vertical beams 11 on the upstream and downstream sides of the panels. This arrangement allows a workman to remove and replace the pads 8 by simply removing the bolts 15 to release the horizontal cross members 14 and then lifting out the pads. Thereafter, new pads can be secured in the frame by reversing this process. In this regard, it should be noted that an access door 16 is provided in the wall of the housing 2 as shown in the drawings to enable the workman to replace the panels 8 from the downstream side of the frame 10.

Figure 4:
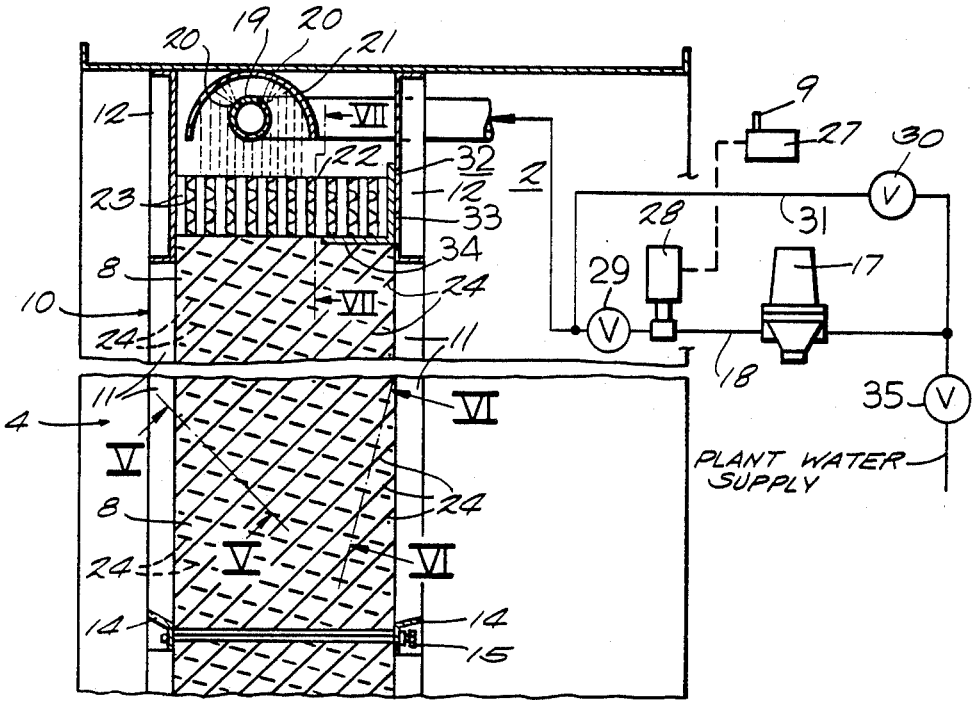
FIG. 4 is an enlarged cross-sectional view taken along line IV—IV in FIG. 1.

As shown in FIG. 4, the invention provides for feeding water into the top of the media panels 8 through an elongated water distribution pad 22 overlying the upper edge of the panels to maintain the panels at the desired level of saturation during gas treating operations. In the embodiment shown, water is fed from the plant or city water supply to a main water supply pipe 18 including a flow control valve 35 such as the variable orifice flow control valve sold under the trademark MESURFLO by Zurn Industries, a pressure regulator 17 which limits the maximum water pressure in the pipe 18 and a normally open valve 29. During normal operations, water flows from the main supply pipe 18 into a water pipe 19 which has a plurality of nozzles or orifices 20 spaced along its upper surface which are adapted to direct sprays of water against the interior face of an inverted U-shaped channel 21 extending coextensively above the pipe 19. As shown in FIG. 4, the channel 21 and associated nozzles 20 are mounted so they are off-set from the center of the pad 22 toward the upstream side of the pad. This arrangement provides for a relatively uniform widthwise distribution of water across the top of the water distribution pad 22 as water falls from the channel 21. Then, as the water flows through the distribution pad 22, it is dispersed even further to assure its uniform distribution across the top of the upper row of media pads 8.

Figure 5:
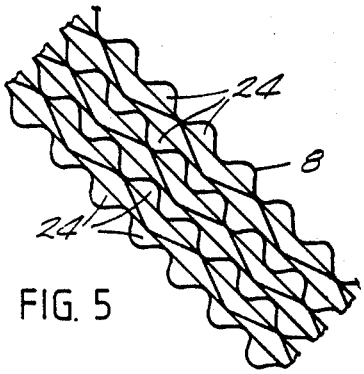
FIG. 5 is an enlarged view of the media pad material taken along line V—V in FIG. 4.
Figure 6:
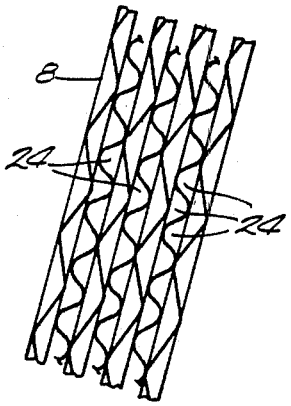
FIG. 6 is an enlarged view of the media pad material taken along line VI—VI in FIG. 4.
Figure 7:
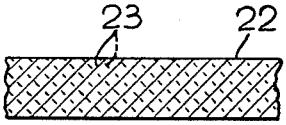
FIG. 7 is a partial cross-sectional view taken along line VII—VII in FIG. 4.

Referring to FIGS. 4–6, both the distribution pad 22 and the media pads 8 are of a corrugated construction of laminated sheets. In the preferred embodiment, the sheets are formed of a cellulose paper impregnated with insoluable anti-rot salts, rigidifying saturants and wetting agents similar to that sold under the CELdek trademark by the Munters Corporation, although it is to be understood that various other papers, as well as various fiberglass products, are also contemplated for this purpose.

As shown in the drawings, the passages 23 formed by the corrugations in the distribution pad 22 extend downwardly and outwardly toward the outer vertical edges of the media pads 8 at a downward angle of about 45°. Approximately one-half of the passages 23 extend toward one outer vertical edge and the remaining passages 23 extend toward the other vertical edge. Experience has shown this arrangement tends to create a more uniform water flow distribution across the entire length of the distribution pad. In addition to the foregoing, a drain plate member 32 of a generally L-shaped cross-sectional configuration is secured across the downstream edge of the distribution pad 22. As shown in FIG. 4, the plate member 32 includes a vertically extending plate portion 33 encasing the downstream edge of the pad 22 and a horizontal plate portion 34 sandwiched between the distribution pad 22 and the top of the media pads 8. This arrangement is believed to retard water droplet carryover in the air stream as it flows out of the media since it promotes greater saturation of the media pads near their upstream sides where the greatest degree of evaporation is believed to occur.

In contrast to the distribution pad 22, about one-half of the passages 24 in the media pads 8 extend downwardly toward the upstream side of the pads at an acute angle of about 45° to the horizontal and the remaining passages 24 extend downwardly toward the downstream side of the pads at a second acute angle of about 15° to the horizontal. As in the case of the distribution pad 22, this configuration has been found to be particularly desirable since it similarly tends to promote greater saturation in the upstream sides of the pads where the greatest degree of evaporation occurs, thereby increasing the extent of humidification in the pads while minimizing the amount of water necessary to maintain the desired humidity in the air stream.

As noted above, the humidity of the air stream as it leaves the housing 2 is very closely controlled by continuously monitoring the humidity of the air in the outlet plenum 7 and then increasing or decreasing the quantity of water fed into the media pads 8 to raise or lower the humidity in the air stream. As shown in FIGS. 1 and 4, the humidity in the outlet plenum 7 is monitored by the humidity sensor 9 which can be any one of a variety of commercially available electrical sensors connected to a logic circuit 27 which compares the humidity detected by the sensor to a preselected humidity level which can be adjusted to detect a range of different humidity levels. The logic circuit 27 is in turn operatively connected to an electrically actuated proportional modulating valve 28 in the main water supply pipe 18. Thus, the arrangement enables an operator to set the logic circuit 27 to maintain the desired humidity level. This arrangement causes the valve 28 to automatically increase or decrease the water flow to maintain the humidity in the air stream at the desired level within the operating range of the system which is determined by the flow rate through the flow control valve 35. In this regard, it should be noted the sensor 9 is positioned downstream from the blower 6 to insure that it detects the humidity of the gas stream as a whole and not localized conditions in the duct as well as to take into account the heat added to the air stream as it passes through the blower. Additionally, since the modulating valve 28 constantly regulates the rate the water is fed into the media pads 8 in proportion to the differential between the humidity detected by the sensor 9 and the humidity level selected by the operator, the arrangement essentially minimizes water consumption by the system as it only allows the saturation within the panels to proceed to the minimum point necessary to maintain the desired humidity. For example, in a situation where the humidity in the ambient air was only 10–15 percent below the desired humidity, the water flow could be such that only a portion of the pads would be saturated. Thus, the majority or all of the water fed into the pads is used by the system in contrast to those arrangements discussed in regard to the prior art where it is generally necessary to recirculate excess water accumulating beneath the evaporative pads provided in those arrangements to reduce water consumption.

In addition to the above and as shown in FIG. 4, a bypass pipe 29 including a normally closed valve 30 is connected in parallel with the normally open valve 29, the pressure regulator 17, and the modulating valve 28. This feature allows an operator to manually bypass the sensor control valve 28 by simply closing the valve 29 and opening the valve 30 to flush the media pads, or alternatively, continue operation of the system in the event of a temporary malfunction of the sensor 9 or the modulating valve 28.

From the foregoing, it can be seen that the system can also be used to maintain a preselected dry bulb temperature in the air stream so the system can be used for localized evaporative cooling. Although not shown in the drawings, in such an arrangement a thermocouple or other commercially available temperature sensor is secured in the outlet plenum 7 in essentially the same fashion as the humidity sensor 9. As in the case of the first embodiment, the temperature sensor is operatively connected to the modulating valve 28 which in turn varies the water flow to the panels to maintain the desired temperature in the air stream.

The embodiments of the invention in which an exclusive property or privilege is claimed are defined as follows:

1. An evaporative gas treating system for conditioning a gas stream, comprising:

a housing forming a duct having upstream and downstream ends adapted to conduct the gas stream through the housing;

a vertical panel of flow-through evaporative media secured across the upstream end of the duct;

a blower mounted within the duct downstream from the evaporative panel adapted to draw the gas stream through the duct;

liquid dispersal means adapted to conduct an evaporative liquid into the panel which evaporates into the gas stream as it flows through the panel;

a liquid distribution pad overlying the upper edge of said panel beneath the liquid dispersal means for dispersal of liquid across the upper edge of said panel;

said liquid dispersal means spanning the length of said liquid distribution pad and being off-set from the center of said pad toward the upstream edge of the pad;

a drain plate member of a generally L-shaped cross-sectional configuration spanning the length of said liquid distribution pad, said member including a vertically extending plate portion encasing the downstream edge of the pad and a generally horizontal plate portion extending a preselected distance between the pad and the top of the panel adapted to conduct liquid in the pad toward the upstream side of the panel;

said liquid dispersal means including an inverted U-shaped channel spanning the width of the panel aligned above its upper edge, and a pipe extending coextensively beneath said channel having a plurality of orifices distributed across the arcuate upper half of the pipe adapted to direct sprays of liquid against the total interior face of the channel to effect a relatively uniform distribution of the liquid widthwise across the upper edge of the panel as the liquid falls from the channel;

liquid supply means connected with said liquid dispersal means adapted to conduct a metered flow of liquid to said dispersal means; and sensor means mounted within the duct downstream from the blower for measuring a preselected condition in the gas stream proximate said sensor means, said sensor means being operatively connected with said liquid supply means to selectively increase and decrease the flow of liquid into the panel through the dispersal means to maintain said condition in the gas stream at a predetermined magnitude downstream from the panel.

2. The gas treating system of claim 1, and said liquid dispersal means being secured across the top of the evaporative panel and being adapted to conduct the evaporative liquid into the top of the panel so the liquid migrates downwardly within the panel.

3. The gas treating system of claim 2, and said elongated liquid distribution pad overlying the upper edge of said panel beneath said liquid dispersal means, said pad being of a corrugated construction of laminated sheets wherein about one-half of the channels formed by the corrugations in the pad extend downwardly and outwardly toward one vertical edge of the panel and the remaining channels extend downwardly and outwardly toward the opposite vertical edge of the panel.

4. The gas treating system of claim 3, wherein said orifices are spaced across the upper surface of said pipe.

5. The gas treating system of claim 1, and said liquid supply means having a main supply pipe adapted to connect a water source to said dispersal means including a pressure regulating valve to limit the maximum pressure of the liquid flowing through the supply pipe to a preselected pressure and an electrically actuated proportional valve operatively connected with said sensor means to control the flow of liquid into the dispersal means, and a bypass pipe adapted to be connected in parallel with the supply pipe between the water source and the dispersal means including a valve for selectively controlling the flow of liquid through the supply pipe.

6. The gas treating system of claim 1, and said sensor means being adapted to measure the humidity of the gas stream.

7. The gas treating system of claim 1, and said sensor means being adapted to measure the dry bulb temperature of the gas stream.

8. The gas treating system of claim 1, and said housing including a flow-through frame secured across the duct wherein said panel is formed of a plurality of adjacent media pads removably secured within the frame.

* * * * *